US008007073B2

(12) United States Patent
Murayama

(10) Patent No.: US 8,007,073 B2
(45) Date of Patent: Aug. 30, 2011

(54) LIQUID EJECTING APPARATUS AND METHOD OF WIPING LIQUID DISCHARGE HEAD IN LIQUID EJECTING APPARATUS

(75) Inventor: Masato Murayama, Kotobuki-Koaka (JP)

(73) Assignee: Seiko Epson Corporation, Tokyo (JP)

( * ) Notice: Subject to any disclaimer, the term of this patent is extended or adjusted under 35 U.S.C. 154(b) by 515 days.

(21) Appl. No.: 12/169,833

(22) Filed: Jul. 9, 2008

(65) Prior Publication Data

US 2009/0015630 A1 Jan. 15, 2009

(30) Foreign Application Priority Data

Jul. 10, 2007 (JP) ..... 2007-180538

(51) Int. Cl.
*B41J 2/165* (2006.01)

(52) U.S. Cl. ..... 347/33; 347/22; 347/28; 347/31; 347/32; 347/34; 347/35; 347/36; 347/37; 347/38; 347/39

(58) Field of Classification Search ..... 347/12–13, 347/20–94
See application file for complete search history.

(56) References Cited

U.S. PATENT DOCUMENTS

| | | | | |
|---|---|---|---|---|
| 5,456,539 | A * | 10/1995 | Wright et al. | 400/82 |
| 6,984,017 | B1 * | 1/2006 | Berry et al. | 347/29 |
| 7,255,419 | B2 * | 8/2007 | Berry et al. | 347/29 |
| 7,661,810 | B2 * | 2/2010 | Takatsuka | 347/104 |

FOREIGN PATENT DOCUMENTS

| | | |
|---|---|---|
| JP | 2001-054949 | 2/2001 |
| JP | 2005-096370 | 4/2005 |

* cited by examiner

*Primary Examiner* — Ryan Lepisto
*Assistant Examiner* — Guy Anderson
(74) *Attorney, Agent, or Firm* — Maschoff Gilmore & Israelsen

(57) ABSTRACT

A liquid ejecting apparatus includes two liquid discharge heads, a wiper unit, and an actuating mechanism. Each of the two liquid discharge heads has a nozzle face on which at least one nozzle opening for discharging liquid is formed. The two liquid discharge heads are located so that the nozzle faces of the two liquid discharge heads face each other. The wiper unit is pressed against each of the nozzle faces of the two liquid discharge heads at a position at which the wiper unit is placed between the nozzle faces of the two liquid discharge heads. The actuating mechanism reciprocally moves the wiper unit relatively along the nozzle faces of the two liquid discharge heads.

5 Claims, 7 Drawing Sheets

LIQUID EJECTING APPARATUS AND METHOD OF WIPING LIQUID DISCHARGE HEAD IN LIQUID EJECTING APPARATUS

BACKGROUND

1. Technical Field

The present invention relates to a liquid ejecting apparatus that discharges liquid in an ink jet manner and a method of wiping a liquid discharge head in a liquid ejecting apparatus.

2. Related Art

In an existing art, an ink jet printer is widely used. The ink jet printer prints out a desired image in such a manner that ink droplets are selectively discharged from a large number of nozzle openings, which are formed on the nozzle face of a print head, toward a sheet of paper.

Here, it has been known that, in the ink jet printer, if ink in the nozzle openings dries, it is difficult for ink to be discharged from the nozzle openings because of an increase in viscosity of ink, solidification of ink, or the like, thus resulting in defective print. In order to prevent such defective print, a wiper unit that wipes away ink adhered on the nozzle face is provided for the ink jet printer. For example, when the power is turned off or when a user instructs a cleaning operation, the ink jet printer performs wiping that ink adhered on the nozzle face is wiped away in such a manner that a wiper blade of the wiper unit is pressed against the nozzle face of the print head and then the wiper unit is reciprocally moved relative to the nozzle face, which is, for example, described in JP-A-2001-54949 and JP-A-2005-96370.

In addition, there are ink jet printers that include two print heads. One of the printers that includes two print heads has been known as a printer that is capable of performing duplex printing in such a manner that, for example, the two print heads are configured to face each other across a path through which a sheet of paper is transported.

However, when the two print heads each include a wiping unit in order to perform wiping on the printer that includes the two print heads, the two wiping units should be provided in total. Thus, there has been a problem that the structure of the printer is complicated.

SUMMARY

An advantage of some aspects of the invention may be implemented as the following aspects or application examples.

First Application Example

A liquid ejecting apparatus includes two liquid discharge heads, a wiper unit, and an actuating mechanism. Each of the two liquid discharge heads has a nozzle face on which at least one nozzle opening for discharging liquid is formed. The two liquid discharge heads are located so that the nozzle faces of the two liquid discharge heads face each other. The wiper unit is pressed against each of the nozzle faces of the two liquid discharge heads at a position at which the wiper unit is placed between the nozzle faces of the two liquid discharge heads. The actuating mechanism reciprocally moves the wiper unit relatively along the nozzle faces of the two liquid discharge heads.

According to the above configuration, the wiper unit that is pressed against each of the nozzle faces of the two liquid discharge heads is reciprocally moved along the nozzle faces, so that wiping by which liquid adhered on the nozzle faces is wiped away is performed on the two liquid discharge heads even with a simple configuration that includes one wiping unit.

Second Application Example

In the liquid ejecting apparatus, the wiper unit may include a wiper mechanism that presses a wiper member against each of the nozzle faces.

According to the above configuration, because the wiper member is pressed against each of the nozzle faces by the wiper mechanism, it is possible to reliably wipe away liquid that is adhered on the nozzle faces.

Third Application Example

In the liquid ejecting apparatus, each of the liquid discharge heads may be a line head that has a plurality of the nozzle openings formed over a range corresponding to the width of a target medium to which liquid is discharged.

According to the above configuration, it is possible to perform wiping on the two line heads with a simple configuration that includes one wiper unit.

Fourth Application Example

In the liquid ejecting apparatus, the nozzle faces of the two liquid discharge heads may face each other across a path through which a target medium, to which liquid is discharged, is transported.

According to the above configuration, it is possible to perform wiping on the liquid ejecting apparatus that discharges liquid on both sides of a medium with a simple configuration that includes one wiper unit.

Fifth Application Example

A method of wiping a liquid discharge head in a liquid ejecting apparatus that includes two liquid discharge heads, each of which has a nozzle face on which at least one nozzle opening for discharging liquid is formed, that are located so that the nozzle faces face each other, and a wiper unit that wipes away each of the nozzle faces includes reciprocally moving the wiper unit relatively along each of the nozzle faces of the two liquid discharge heads while the wiper unit is being pressed against each of the nozzle faces of the two liquid discharge units.

According to the above configuration, it is possible to perform wiping on the two liquid discharge heads with a simple configuration that has only one wiper unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment according to the invention will be described with reference to the accompanying drawings.

Figure 1:
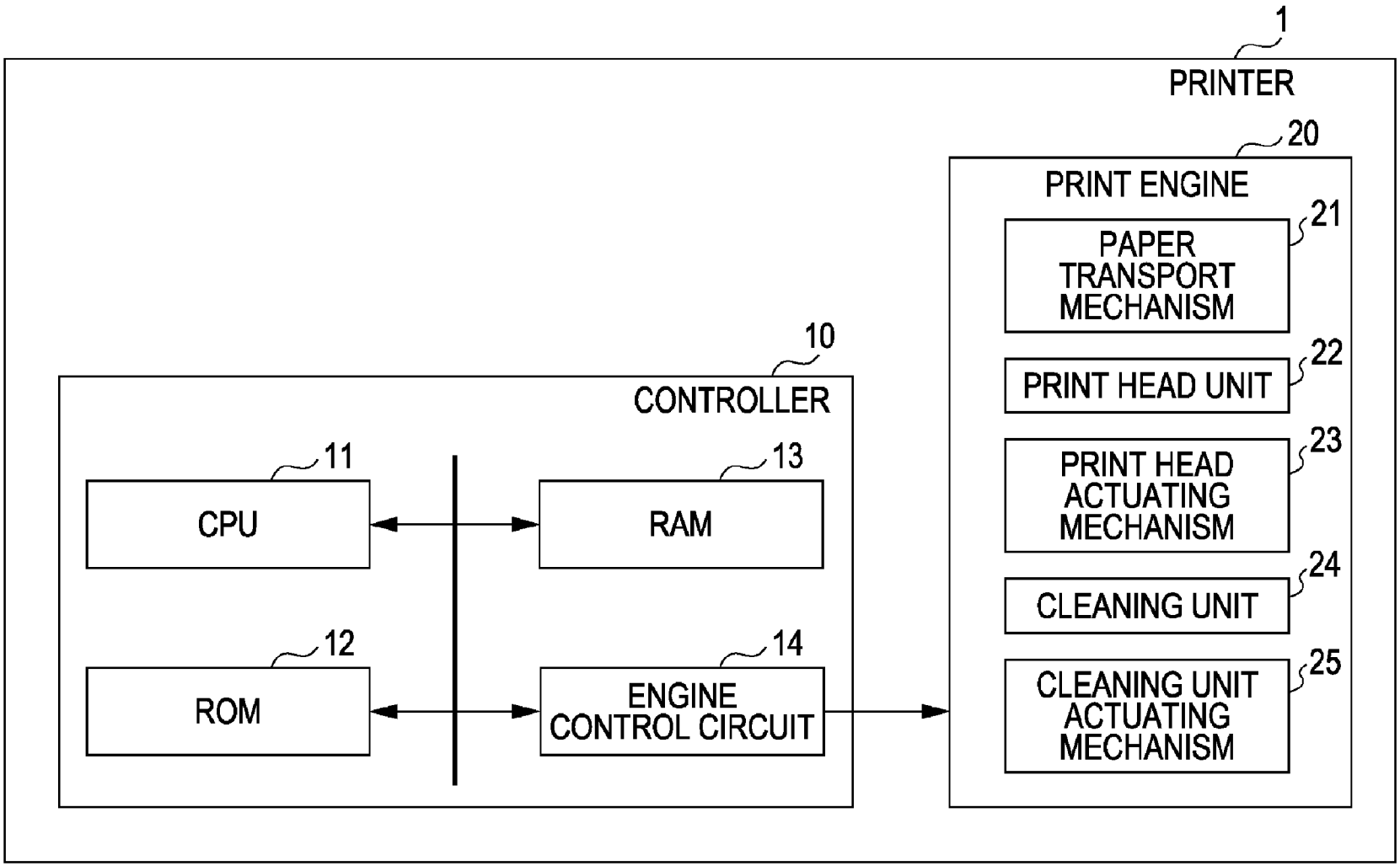
FIG. 1 is a block diagram that shows the configuration of a printer.

The present embodiment will be described by taking a printer that has a print head of which the width corresponds to a paper width, that is, a so-called line head printer, for example. FIG. 1 is a block diagram that shows the configuration of the printer. As shown in FIG. 1, the printer (liquid ejecting apparatus) 1 includes a controller 10 that controls the operations of the printer 1 and a print engine 20 that performs printing on the basis of instructions from the controller 10.

The controller 10 includes a CPU 11, a ROM 12, a RAM 13, and an engine control circuit 14. The ROM 12 stores a control program for controlling the printer 1. The CPU 11 is a main control device of the printer 1 and controls the printer 1 in accordance with the control program stored in the ROM 12. Specifically, the CPU 11 issues an instruction to the engine control circuit 14, and the engine control circuit 14 controls the operation of the print engine 20 in accordance with the instruction from the CPU 11. Thus, various operations, such as printing, are controlled.

Figure 2:
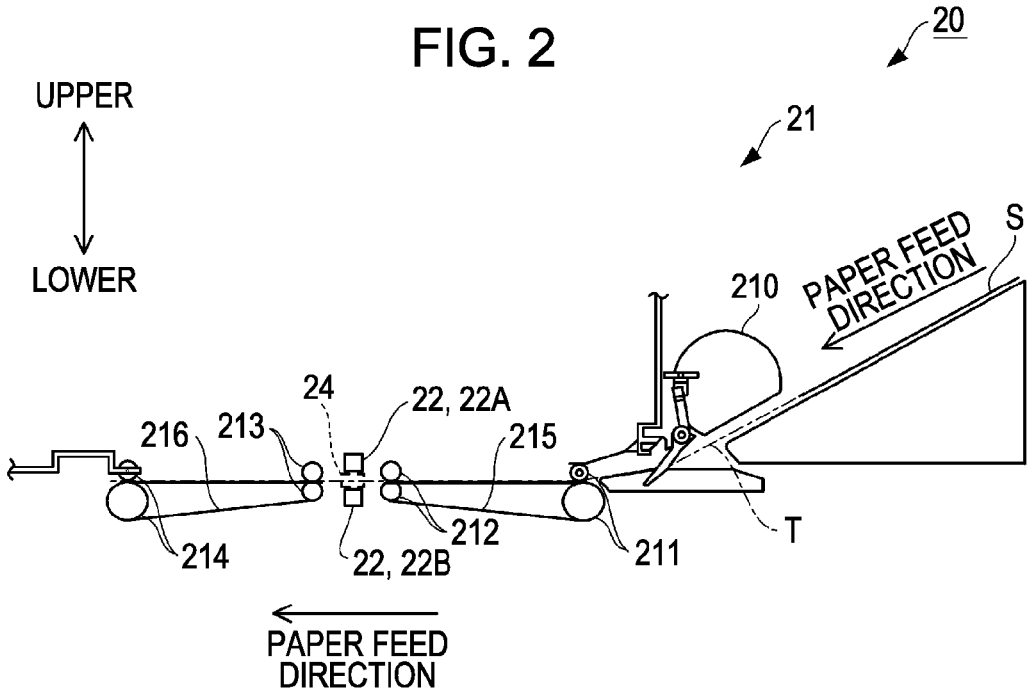
FIG. 2 is a view that shows the configuration of a print engine.

Next, the configuration of the print engine 20 will be described with reference to FIG. 1 and FIG. 2. The print engine 20 includes a paper transport mechanism 21, print head units (liquid discharge heads) 22, a print head actuating mechanism 23, a cleaning unit 24, and a cleaning unit actuating mechanism (actuating mechanism) 25. Note that, in the following description, an upward direction in FIG. 2 is referred to as upper and a downward direction in FIG. 2 is referred to as lower.

The paper transport mechanism 21 feeds and delivers a sheet of paper and also transports a sheet of paper inside the engine. Thus, as shown in FIG. 2, the paper transport mechanism 21 includes a paper feed roller 210, transport roller pairs 211, 212, 213, and 214, an upstream transport belt 215, and a downstream transport belt 216. The paper feed roller 210 feeds a sheet of paper (medium) S that is placed in a predetermined tray. Each of the transport roller pairs 211, 212, 213, and 214 has a pair of upper and lower rollers. The upstream transport belt 215 is looped between the lower roller of the transport roller pair 211 and the lower roller of the transport roller pair 212. The downstream transport pair 216 is looped between the lower roller of the transport roller pair 213 and the lower roller of the transport roller pair 214. A driving motor (not shown) is coupled to an end portion of the rotary shaft of each of the paper feed roller 210 and the transport roller pairs 211, 212, 213, and 214. The controller 10 instructs the driving motors to control rotation of each roller. Thus, the sheet of paper S is transported along a paper transport path T that passes the paper feed roller 210, the transport roller pair 211, the upstream transport belt 215, the transport roller pairs 212 and 213, the downstream transport belt 216 and the transport roller pair 214 in the stated order. Note that, when a sheet of paper is transported, the sheet of paper S is transported in a state where the sheet of paper S is adsorbed on a transport belt through electrostatic adsorption or air suction onto the upstream transport belt 215 and the downstream transport belt 216.

Figure 3:
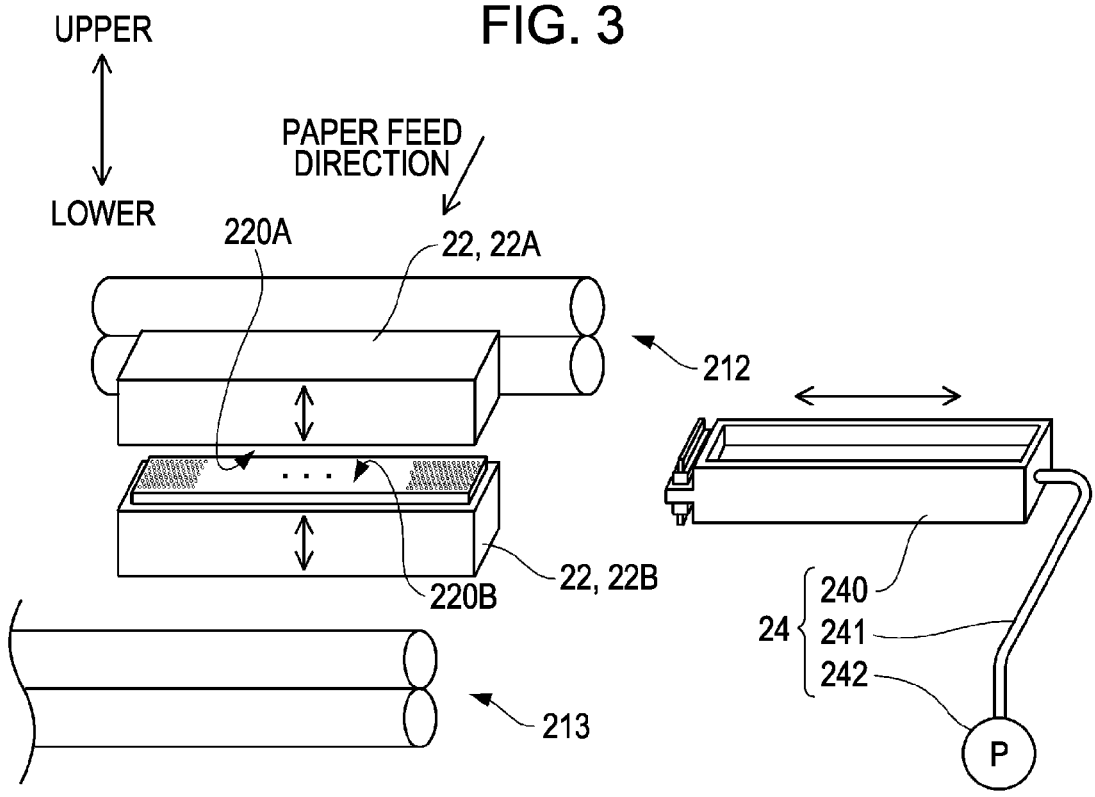
FIG. 3 is a perspective view that shows the configuration of print head units and the configuration of a cleaning unit.

Next, the print head units 22 and the cleaning unit 24 will be described. FIG. 3 is a perspective view that shows the configuration of the print head units 22 and the configuration of the cleaning unit 24. As shown in FIG. 2 and FIG. 3, the printer 1 has the pair of upper and lower print head units 22 that are arranged vertically so that the paper transport path T formed between the transport roller pairs 212 and 213 is placed in between. Note that, hereinafter, the print head unit 22 that is provided on the upper side with respect to the paper transport path T formed between the transport roller pairs 212 and 213 is referred to as an upper print head unit 22A, and the print head unit 22 that is provided on the lower side with respect to the paper transport path T is referred to as a lower print head unit 22B.

Here, a nozzle face 220A, which is a face on which the nozzles of the upper print head unit 22A are formed, faces downward and is opposed to the paper transport path T. A nozzle face 220B, which is a face on which the nozzles of the lower print head unit 22B are formed, faces upward and is opposed to the paper transport path T. Thus, the printer 1 is able to perform duplex printing in such a manner that ink is discharged vertically from both sides to the sheet of paper S that is transported along the paper transport path T.

Figure 4:
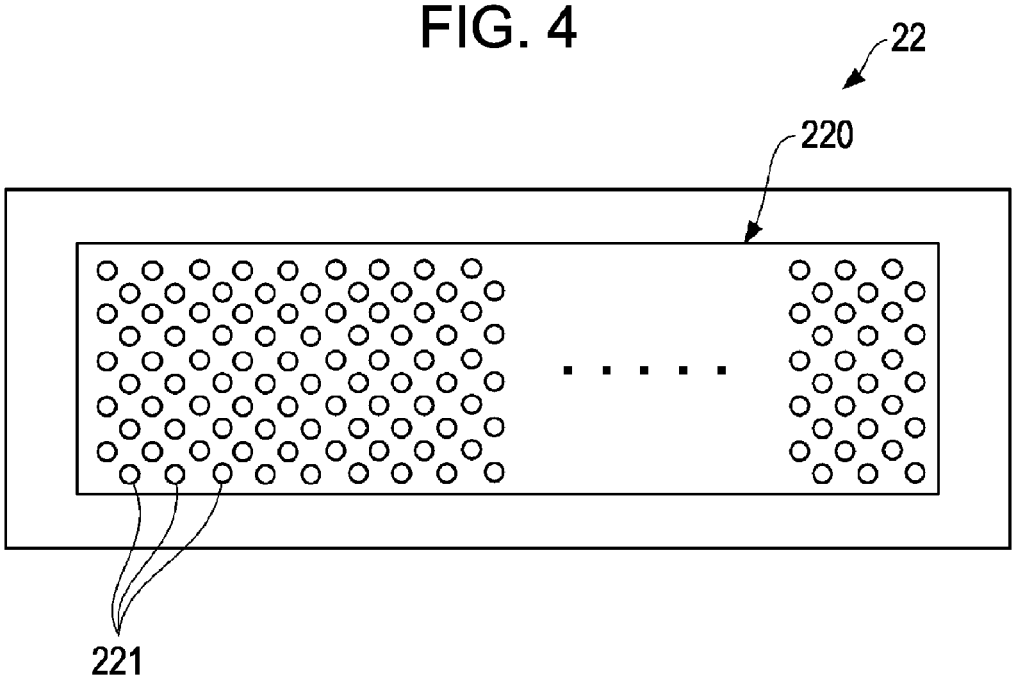
FIG. 4 is a view that shows the configuration of the print head unit.

Note that the upper print head unit 22A and the lower print head unit 22B are line ink jet heads that are manufactured by means of semiconductor technology. Although not shown in the drawing, in the upper print head unit 22A and the lower print head unit 22B, a plurality of substrates in which a large number of nozzles are formed in high density by means of semiconductor technology are arranged on a plate in a line. In addition, as shown in FIG. 4, a large number of nozzle openings 221 that are arranged in a staggered manner are formed in each of the nozzle faces 220 of the print head units 22A and 22B. The width in the long side direction in which a large number of nozzles are arranged corresponds to the paper width, and an ink chamber and a piezoelectric element that expands or contracts the ink chamber are provided inside each nozzle. Thus, the printer 1 drives the piezoelectric elements and then discharges ink from a large number of nozzles, which are arranged in high density, toward the sheet of paper S. In this way, it is possible to perform high-resolution printing at high speed.

Next, the cleaning unit 24 will be described. As shown in FIG. 3, the cleaning unit 24 includes a cleaning unit body (wiper unit) 240, a tube 241, and a suction pump 242.

Figure 5:
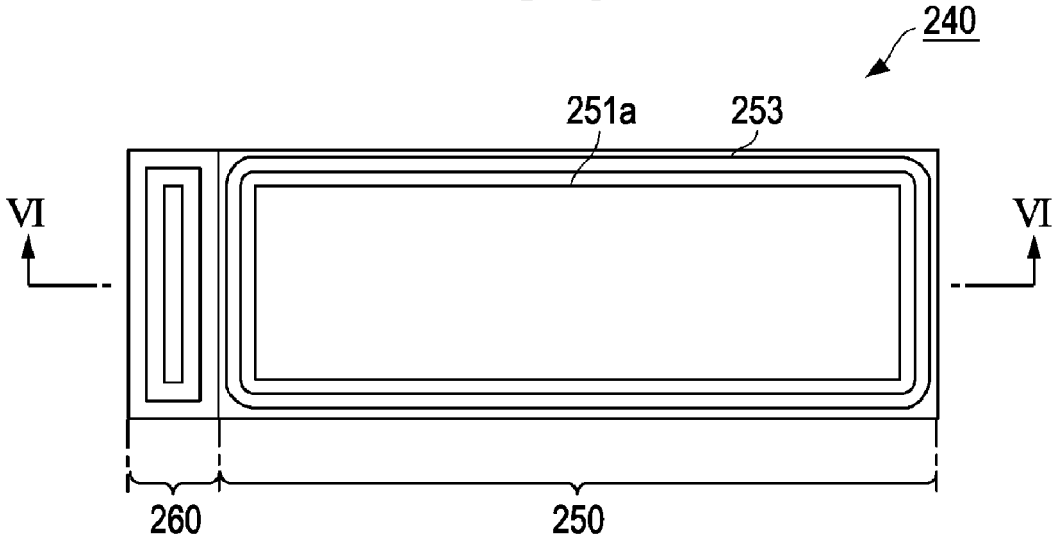
FIG. 5 is a view that shows the configuration of a cleaning unit body.
Figure 6:
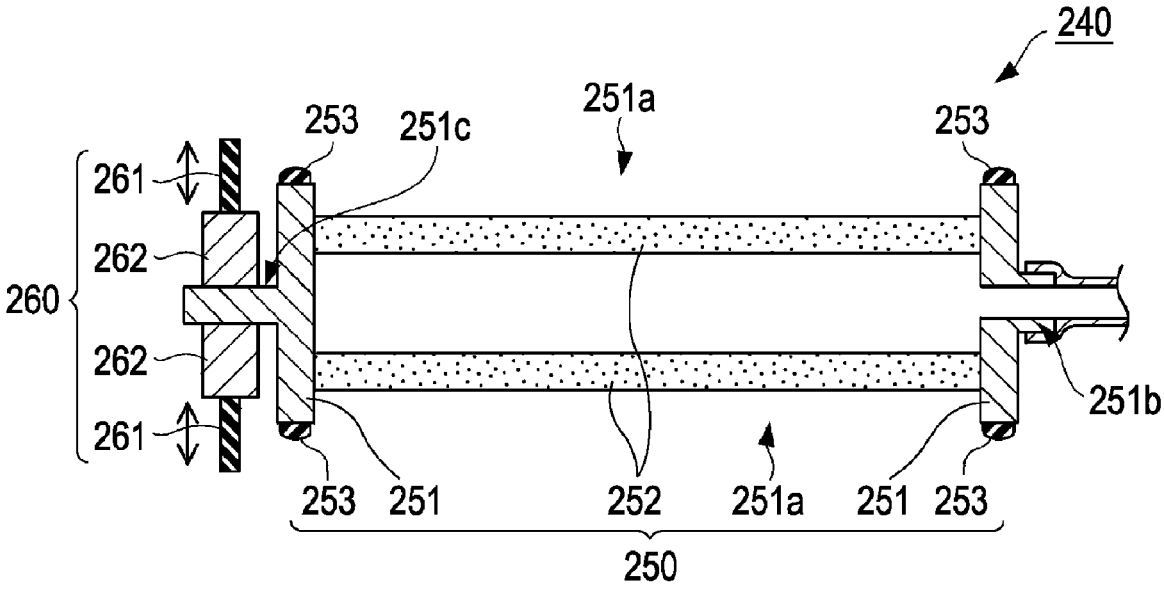
FIG. 6 is a cross-sectional view of the cleaning unit body, taken along the line VI-VI in FIG. 5.

FIG. 5 is a view that shows the configuration of the cleaning unit body 240. FIG. 6 is a cross-sectional view of the cleaning unit body 240, taken along the line VI-VI in FIG. 5. As shown in FIG. 5, the cleaning unit body 240 includes a cleaning portion 250 and a wiping portion 260. The cleaning portion 250 is wide in correspondence with the longitudinal direction of the nozzle face of the print head unit 22. The wiping portion 260 is provided to one end of the cleaning portion 250.

The cleaning portion 250, as shown in FIG. 5 and FIG. 6, includes a box-shaped unit frame 251, porous members 252, and packings 253. The unit frame 251 has suction ports 251*a*, which serve as openings, formed on the upper side and on the lower side. The porous members 252 are respectively provided to the inner side than the suction ports 251*a* so as to close the openings. The packings 253 are provided at the upper end and lower end of the unit frame 251 so as to surround the upper and lower suction ports 251*a*. In addition, an air intake port 251*b* is provided at one end of the unit frame 251 in the longitudinal direction. One end of the tube 241 is connected to the air intake port 251*b*, and the other end of the tube 241 is connected to the suction pump 242. That is, the suction pump 242 is in fluid communication through the tube 241 to the inside of the cleaning unit body 240.

Here, a protrusion 251*c* is formed at the other end of the unit frame 251, which is the side opposite to the side on which the air intake port 251*b* is provided, and the protrusion 251*c* extends outward in the longitudinal direction. The wiping portion 260 is integrated with the cleaning portion 250 so that the wiping portion 260 is attached to the protrusion 251*c*. The wiping portion 260 has two wiper blades (wiper members) 261 and wiper mechanisms 262. Each of the wiper blades 261 has a width corresponding to the short side direction of the nozzle face. The wiper mechanisms 262 are provided on the upper side and lower side of the protrusion 251*c*. Each of the wiper mechanisms 262 supports one wiper blade 261. The wiper blade 261 is formed of an elastic member, such as rubber or elastomer. Each wiper mechanism 262 internally includes a mechanism for vertically moving an actuator and the wiper blade 261, and is able to retract the wiper blade 261 to the inside of the wiper mechanism 262 or let out the wiper blade 261 to the outside of the wiper mechanism 262.

The print head actuating mechanism 23 is a mechanism that moves each of the print head units 22A and 22B vertically. The cleaning unit actuating mechanism 25 is a mechanism that horizontally moves the cleaning unit body 240 from a predetermined standby position to a position just below the upper print head unit 22A and just above the lower print head unit 22B. Although not specifically described in detail, each of the print head actuating mechanism 23 and the cleaning unit actuating mechanism 25 has a motor driven slider and is configured so that the print head unit 22 or the cleaning unit body 240 is mounted on the slider. However, the configuration of the print head actuating mechanism 23 and the configuration of the cleaning unit actuating mechanism 25 are not limited to them. It is applicable that the print head actuating mechanism 23 or the cleaning unit actuating mechanism 25 is moved by letting out a belt that is engaged with the print head unit 22 or the cleaning unit 24, and it is also applicable that the print head actuating mechanism 23 or the cleaning unit actuating mechanism 25 is moved through a gear mechanism, such as a rack and pinion.

Next, the cleaning operation that is performed by the above described printer 1 will be described. The cleaning operation, which will be described below, is performed when a computer (not shown) issues an instruction to perform the cleaning operation, when printing has not been performed for a predetermined period of time and then the printer 1 is switched to a sleep state, when the power of the printer 1 is turned off, or the like.

Figure 7A:
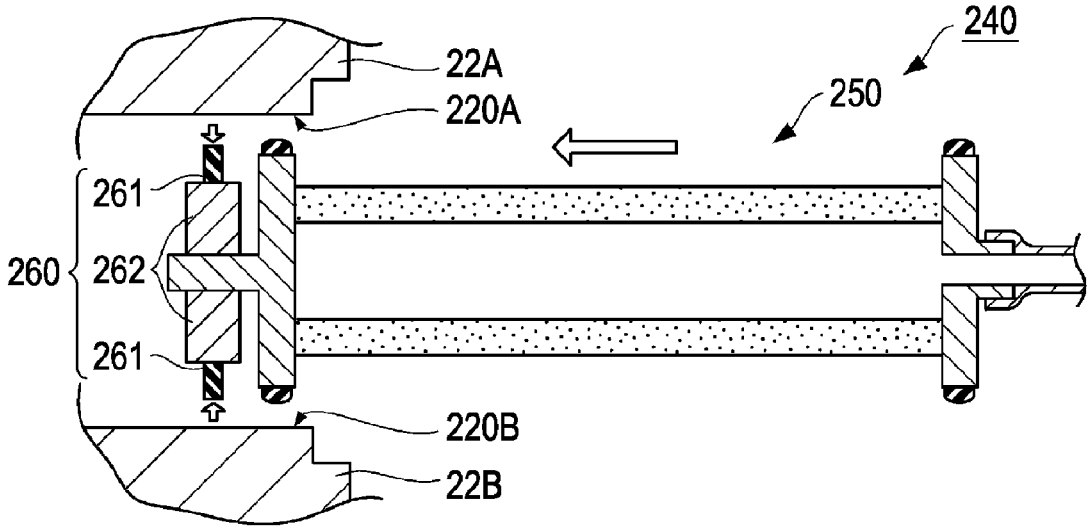
FIG. 7A and FIG. 7B are views that illustrate a cleaning operation.

In the cleaning operation, first, the controller 10 instructs the wiper mechanisms 262 to retract the wiper blades 261 to the insides of the wiper mechanisms 262 so that the wiper blades 261 do not contact the nozzle face. Then, the controller 10 instructs the cleaning unit actuating mechanism 25 to move the cleaning unit body 240 so that the cleaning portion 250 is located just below the print head unit 22A and just above the print head unit 22B (see FIG. 7A).

Figure 7B:
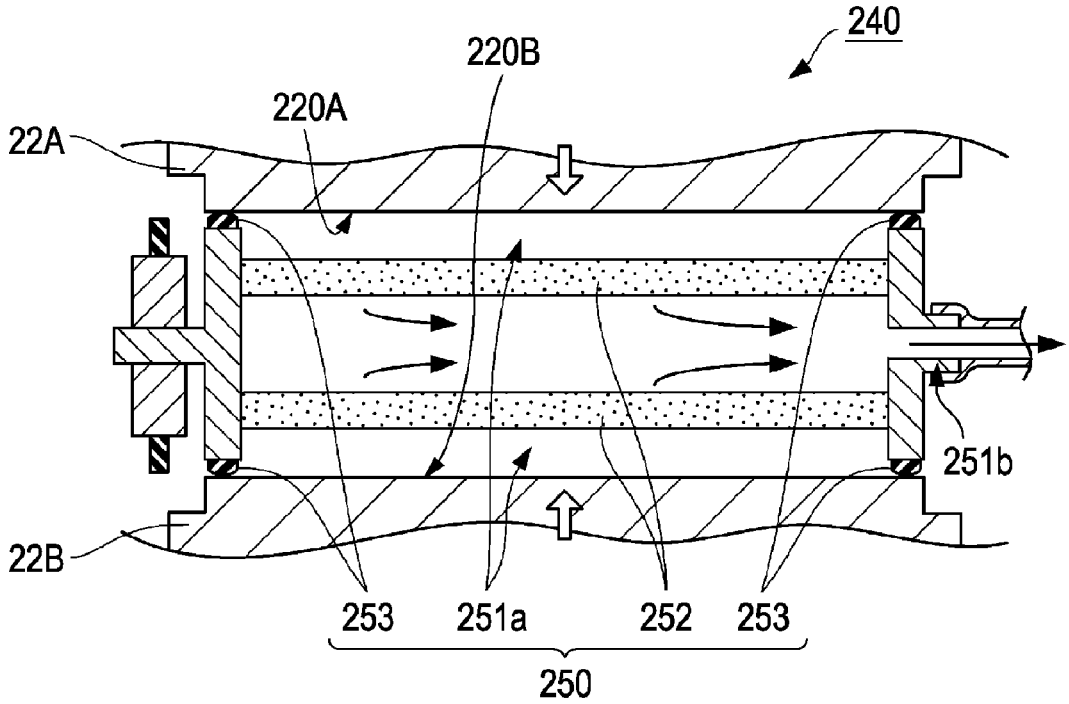

Next, the controller 10 instructs the print head actuating mechanism 23 to lower the upper print head unit 22A and also to raise the lower print head unit 22B. In this manner, the print head units 22A and 22B place the cleaning unit body 240 vertically in between (see FIG. 7B). At this time, gaps between the print head units 22A and 22B and the cleaning portion 250 of the cleaning unit body 240 are hermetically sealed by the packings 253.

Then, the controller 10 instructs the suction pump 242 to draw air through the air intake port 251*b* to thereby apply a negative pressure to the inside of the cleaning unit body 240. Owing to the negative pressure applied, ink that is adhered on each of the nozzle faces 220 of the print head units 22A and 22B and in the nozzle openings 221 is drawn to the suction ports 251*a* that face each other and are respectively positioned on the upper side and on the lower side. The drawn ink is absorbed by the porous member 252. In this manner, cleaning is performed on each of the nozzle faces 220 of the two print head units 22A and 22B at a time. As the cleaning has been completed, the controller 10 instructs the print head actuating mechanism 23 to raise the upper print head unit 22A and to lower the lower print head unit 22B. After that, the controller 10 instructs the cleaning unit actuating mechanism 25 to move the cleaning unit 24 to a predetermined standby position. Thus, the cleaning operation is completed.

Next, the wiping operation will be described. The wiping operation, which will be described below, is performed when a computer (not shown) issues an instruction to perform wiping, when the power of the printer 1 is turned off, or the like.

When the wiping operation is performed, first, the controller 10 instructs the wiper mechanisms 262 to let out the wiper blades 261, which are retracted to the insides of the wiper mechanisms 262, to the outside. In this manner, each of the wiper blades 261 is positioned at a level at which the wiper blade 261 is able to contact the nozzle face 220. That is, the upper wiper blade 261 is let out to a position at which the distal end of the blade is located at a position higher than the nozzle face 220A of the upper print head unit 22A. The lower wiper blade 261 is let out to a position at which the distal end of the blade is located at a position higher than the nozzle face 220B of the lower print head unit 22B.

Figure 8:
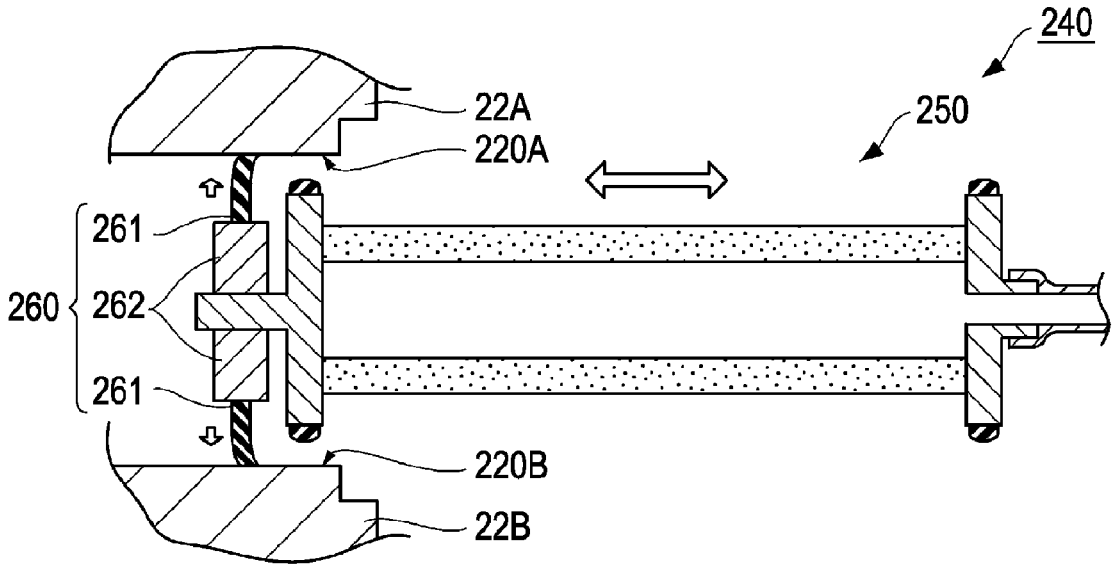
FIG. 8 is a view that illustrates a wiping operation.

Next, the controller 10 instructs the cleaning unit actuating mechanism 25 to reciprocally move the cleaning unit 24 in such a manner that the operation in which the cleaning unit 24 is horizontally moved to a position just below the upper print head unit 22A and just above the lower print head unit 22B and the operation in which the cleaning unit 24 is horizontally drawn out from a position placed between the print head units 22 are repeated (see FIG. 8). At this time, because the upper wiper blade 261 reciprocally moves along the nozzle face 220A while being pressed against the nozzle face 220A of the upper print head unit 22A, ink that is adhered on the nozzle face 220A is wiped away. Similarly, because the lower wiper blade 261 reciprocally moves along the nozzle face 220B while being pressed against the nozzle face 220B of the lower print head unit 22B, ink that is adhered on the nozzle face 220B is wiped away. In this manner, the wiping is performed on the nozzle face 220A of the upper print head unit 22A and the nozzle face 220B of the lower print head unit 22B at a time. As the wiping has been completed, the controller 10 instructs the print head actuating mechanism 23 to raise the upper print head unit 22A and to lower the lower print head unit 22B. After that, the controller 10 instructs the cleaning unit actuating mechanism 25 to move the cleaning unit 24 to a predetermined standby position. Thus, the wiping operation is completed.

According to the above described printer 1, the following advantageous effects may be obtained.

(1) The wiping may be performed at a time in such a manner that adhered ink is wiped away by the one cleaning unit 24 from the nozzle faces 220 of the two print head units 22A and 22B. Thus, in comparison with the case in which a cleaning unit is provided for each of the two print head units 22A and 22B, the configuration of the printer 1 is simple and, therefore, it is possible to achieve the small and light-weight printer 1 at low cost. In addition, in comparison with the case in which the two print head units 22A and 22B are alternately wiped using the existing wiping unit that has a wiper blade on one side, it is possible to reduce time required for wiping.

(2) The cleaning may be performed on the nozzle faces 220 of the print head units 22A and 22B at a time using the one cleaning unit 24. Thus, in comparison with the case in which a cleaning unit is provided for each of the two print head units 22A and 22B, the configuration of the printer 1 is simple and, therefore, it is possible to achieve the small and light-weight printer 1 at low cost. In addition, in comparison with the case in which the two print head units 22A and 22B are alternately cleaned using the existing cleaning unit that has a suction port on one side, it is possible to reduce time required for cleaning.

(3) Because the cleaning portion 250 and the wiping portion 260 are integrated as one unit, the cleaning and the wiping may be performed using one actuating mechanism (the cleaning unit actuating mechanism 25). Thus, it is possible to further simplify the configuration of the printer 1.

(4) When the wiping operation is performed, owing to the wiper mechanisms 262, the distal end of the upper wiper blade 261 is let out to a position that is higher than the nozzle face 220A of the upper print head unit 22A, and the distal end of the lower wiper blade 261 is let out to a position that is lower than the nozzle face 220B of the lower print head unit 22B. In this manner, because each of the wiper blades 261 is reliably pressed against the nozzle face, it is possible to appropriately perform wiping.

The liquid ejecting apparatus is not only limited to the embodiment described above, but it may be modified into various alternative embodiments. Hereinafter, the alternative embodiments will be described.

First Alternative Embodiment

Figure 9:
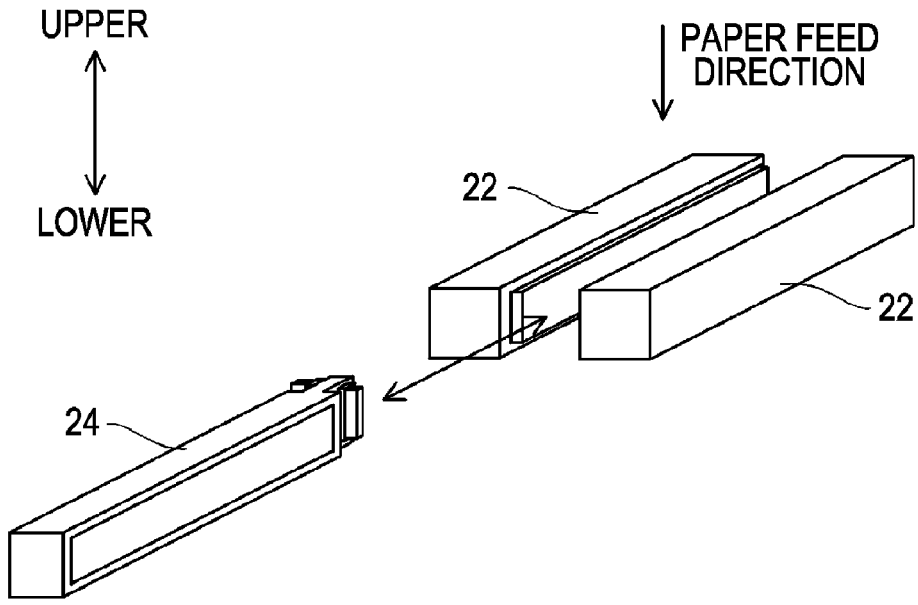
FIG. 9 is a view that illustrates a first alternative embodiment.

In the above embodiment, the two print head units 22A and 22B are arranged on the upper side and on the lower side with respect to the paper transport path T; however, the positional relationship of the print head units is not limited to it. For example, as shown in FIG. 9, when a sheet of paper is transported in a vertical direction, the two print head units 22 may be arranged so as to place the paper transport path T laterally in between.

Second Alternative Embodiment

Figure 10:
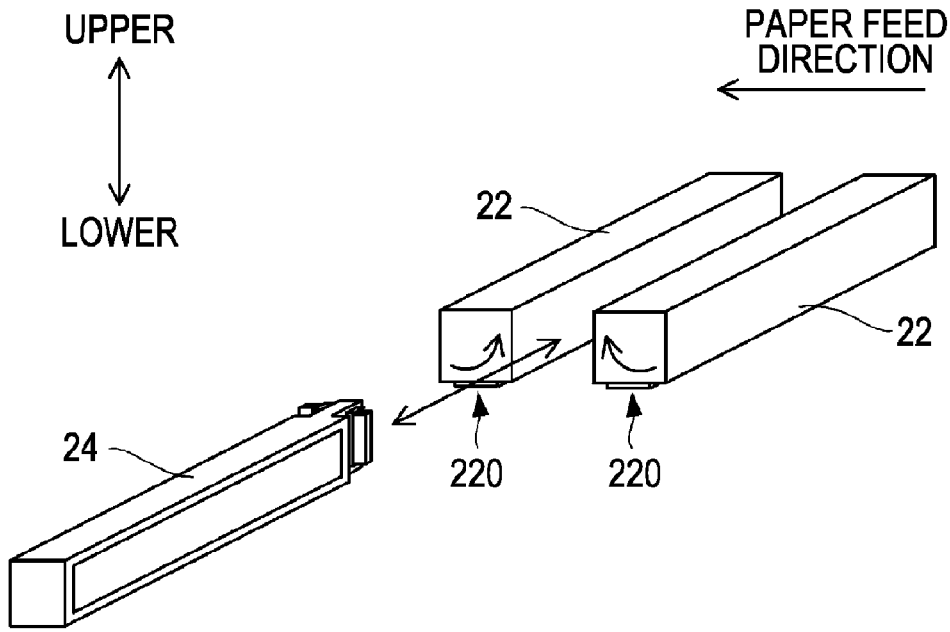
FIG. 10 is a view that illustrates a second alternative embodiment.

In the above embodiment, the printer that performs duplex printing using the two print head units 22A and 22B that face each other is described; however, as shown in FIG. 10, the two print head units 22 may be respectively arranged on the upstream side and on the downstream side in the paper transport path T. For example, when the pitch at which the nozzle openings of the upstream side print head unit are arranged is offset at a half pitch from the pitch at which the nozzle openings of the downstream side print head unit are arranged, it is possible to improve printing resolution. In this case, the cleaning unit body is moved to between the two print head units 22 after the two print head units have been rotated so that their nozzle faces face each other, it is possible to perform cleaning and wiping at a time using one cleaning unit.

Third Alternative Embodiment

In the above embodiment, the positions of the print head units 22A and 22B are fixed and the cleaning unit 24 is moved; however, the cleaning and the wiping may be performed in such a manner that the print head units 22A and 22B are moved relative to the fixed cleaning unit 24.

Fourth Alternative Embodiment

Figure 11:
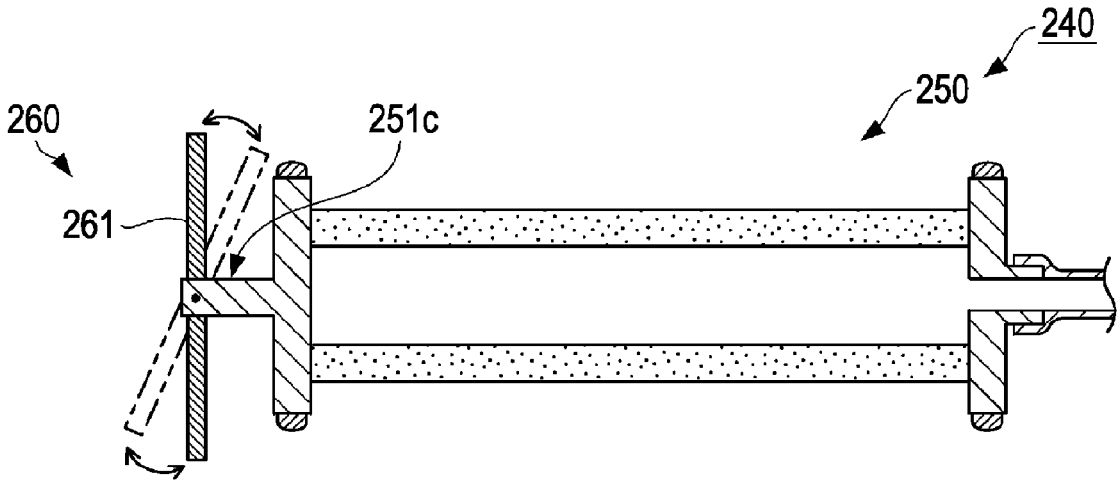
FIG. 11 is a view that illustrates a fourth alternative embodiment.

In the above embodiment, the two wiper blades 261 are provided for one cleaning unit; however, as shown in FIG. 11, the cleaning unit may be configured to include one wiper blade 261. In this case, when wiping is not performed, the wiper blade 261 is rotated so as to be oriented obliquely to thereby avoid interference with the nozzle face 220A or 220B. When wiping is performed, the wiper blade 261 may be oriented upright relative to the nozzle faces 220 and then pressed against the nozzle faces 220.

Fifth Alternative Embodiment

In the above embodiment, the line ink jet printer is described; however, when an apparatus that includes two ink jet print heads, it is possible to apply the same wiping methods to various apparatuses, such as a printer that has scanning print heads.

Sixth Alternative Embodiment

In the above embodiment, the ink jet printer is described as an example of the liquid ejecting apparatus; however, the liquid ejecting apparatus is not limited to it. As far as the liquid ejecting apparatuses, the aspects of the invention may also be applied to various industrial apparatuses other than printers. For example, the aspects of the invention may be applied to a textile printing equipment that prints a pattern on a textile, a color filter manufacturing equipment, a display manufacturing equipment that manufactures an organic EL display, a DNA chip manufacturing equipment that manufactures a DNA chip by applying a solution, in which DNA is dissolved, on a chip, a circuit board manufacturing equipment, or the like. In addition, the printer according to the above embodiment discharges liquid in such a manner that the ink chambers are expanded or contracted by applying a voltage to each driving element (piezoelectric element); however, it is not limited. For example, a printer may be configured to discharge liquid using bubbles that are generated in the nozzles using heater elements.

What is claimed is:

1. A liquid ejecting apparatus comprising:

two liquid discharge heads, each of which has a nozzle face on which at least one nozzle opening for discharging liquid is formed, wherein the two liquid discharge heads are located so that the nozzle faces of the two liquid discharge heads face each other;

a wiper unit that is pressed against both of the nozzle faces of the two liquid discharge heads at a position at which the wiper unit is placed between both the nozzle faces of the two liquid discharge heads; and an actuating mechanism that reciprocally moves the wiper unit relatively along the nozzle faces of the two liquid discharge heads.

2. The liquid ejecting apparatus according to claim 1, wherein the wiper unit includes a wiper mechanism that presses a wiper member against each of the nozzle faces.

3. The liquid ejecting apparatus according to claim 1, wherein each of the liquid discharge heads is a line head that has a plurality of the nozzle openings formed over a range corresponding to the width of a target medium to which liquid is discharged.

4. The liquid ejecting apparatus according to claim 1, wherein the nozzle faces of the two liquid discharge heads face each other across a path through which a target medium, to which liquid is discharged, is transported.

5. A method of wiping a liquid discharge head in a liquid ejecting apparatus that includes two liquid discharge heads, each of which has a nozzle face on which at least one nozzle opening for discharging liquid is formed, that are located so that the nozzle faces face each other, and a wiper unit that wipes away both of the nozzle faces, comprising:

reciprocally moving the wiper unit relatively along both of the nozzle faces of the two liquid discharge heads while the wiper unit is being pressed against both of the nozzle faces of the two liquid discharge units.

* * * * *